US005992205A

United States Patent [19]

Bishop

[11] Patent Number: 5,992,205

[45] Date of Patent: Nov. 30, 1999

[54] MEANS TO MANUFACTURE STEERING RACK BARS

[75] Inventor: Arthur Ernest Bishop, Greenwich, Australia

[73] Assignee: Bishop Steering Pty Limited, North Ryde, Australia

[21] Appl. No.: 09/091,407

[22] PCT Filed: Dec. 12, 1996

[86] PCT No.: PCT/AU96/00823

§ 371 Date: Jun. 22, 1998

§ 102(e) Date: Jun. 22, 1998

[87] PCT Pub. No.: WO97/23316

PCT Pub. Date: Jul. 3, 1997

[30] Foreign Application Priority Data

Dec. 21, 1995 [AU] Australia ..... PN7294

[51] Int. Cl.[6] ..... B21D 22/00

[52] U.S. Cl. ..... 72/360; 72/337

[58] Field of Search ..... 72/360, 343, 352, 72/377, 412, 359, 470, 474, 475

[56] References Cited

U.S. PATENT DOCUMENTS

| | | | |
|---|---|---|---|
| 3,314,278 | 4/1967 | Bergman | 72/359 X |
| 3,842,646 | 10/1974 | Kuhn | 72/359 X |
| 4,587,828 | 5/1986 | Matsumoto et al. | 72/356 |
| 5,862,701 | 1/1999 | Bishop et al. | 72/353.2 |

FOREIGN PATENT DOCUMENTS

| | | | |
|---|---|---|---|
| 26759 | 11/1968 | Japan | 72/377 |
| 58-13431 | 1/1983 | Japan | 72/412 |
| 59-223132 | 12/1984 | Japan | 72/360 |
| 1177-021 | 9/1985 | Russian Federation | 72/360 |
| 556354 | 9/1943 | United Kingdom | 72/352 |
| 2088256 | 6/1982 | United Kingdom | 72/412 |
| 2108026 | 5/1983 | United Kingdom | 72/412 |

*Primary Examiner*—Joseph J. Hail, III
*Assistant Examiner*—Ed Tolan
*Attorney, Agent, or Firm*—Nikaido, Marmelstein, Murray & Oram LLP

[57] ABSTRACT

A die for forming the toothed end of a steering rack bar from a cylindrical blank includes first and second die blocks relatively movable to converge on the blank. The die blocks incorporate opposed generally semicircular recesses to accommodate the blank. One recess incorporates the obverse form of the teeth. The recesses define a main cavity between them, as the die blocks converge to their final closed position. Subsidiary recesses are provided in one or both die blocks at the joint line therebetween, defining chambers at the final closed position. The chambers incorporates stop elements located laterally remote from the main cavity. The stop elements include longitudinally extending abutments on the first die block which overlap respective juxtaposed abutments on the second die block as the final closed position is approached. The stop elements restrict further flow of blank material away from the main cavity, while preventing blank material from flowing between the overlapped juxtaposed abutments. The volume of the chambers at the final closed position is substantially equal to the difference of volume between the rack bar blank and the steering rack bar as finish forged over the toothed end thereof in the main cavity.

4 Claims, 6 Drawing Sheets

MEANS TO MANUFACTURE STEERING RACK BARS

This invention relates to the manufacture of automobile steering rack bars, and particularly but not exclusively to the manufacture of variable ratio rack bars. The process and the design of manufacturing equipment are disclosed, as are related rack designs having particular functional advantages compared to those of the prior art.

BACKGROUND ART

Rack bars normally comprise a round bar with teeth cut or formed at a "toothed end", the remaining non-toothed region referred to as a "shank end". Variable ratio rack bars such as described in U.S. Pat. No. 3,753,378 incorporate teeth of varying cross-section and varying skew angle with respect to the rack bar longitudinal axis, as well as varying tooth pitch. The pinion which engages the rack is usually helical and is installed in the steering gear at an oblique angle to the normal to the rack bar longitudinal axis, henceforth termed the "pinion installation angle". For variable ratio rack bars the teeth at the toothed end of the rack bar are usually symmetrically disposed about a mid point, this "on-centre region" corresponding to the pinion meshing position when the vehicle is steered straight ahead.

The geometry of such teeth makes variable ratio rack bars very difficult to machine by known rack manufacturing processes, and precision forging is therefore often resorted to, notwithstanding the high precision that is required for satisfactory pinion meshing.

The optimum geometry of the teeth of such rack bars varies widely according to specific vehicle requirements, and whether the steering gear is of the power or manual type. When viewed in cross-section normal to the longitudinal axis of the rack bar, the teeth are frequently positioned towards the periphery of the bar so that the bending strength at the toothed end of the rack bar is minimally reduced as compared to that at the shank end.

U.S. Pat. No. 4,116,085 describes a rack bar having at its toothed end a cross section of triangular or "Y" section which is particularly suited for variable ratio racks. Such a rack may be formed in forging dies such as those described in U.S. Pat. No. 4,571,982 and U.S. Pat. No. 5,862,701, and is supported in the steering gear in a V shaped rack pad. The above-referenced United States patents are being incorporated by reference. This arrangement provide resistance to rack roll under the action of tooth meshing forces as described in U.S. Pat. No. 4,116,085. An additional advantage of the above Y section, and of the related manufacturing process, is that the cross-sectional area of the Y section (including the mean height of the teeth in the toothed region) may be made to match that of the round rack bar blank from which the rack is forged, thereby saving material and enabling the construction of a die in which there is no flash. This die construction enables very high forming pressures to be achieved, so that precise filling of the tooth cavities of the die may be achieved even if forging is conducted at relatively low temperatures, the latter which is also conducive to the avoidance of scaling. The Y section of the rack is of larger diameter over corners so that its strength in bending at the toothed end approximately matches that at the shank end. A suitable temperature has been found to be around 700° C. (often referred to as "warm forging") in contrast to a temperature of 1100° C. typically used in conventional hot forging.

This use of a Y section design has been found to be highly desirable in variable ratio power steering gears where a large change of steering ratio is appropriate to the vehicle handling characteristics and, as a result, the skew angle of some of the teeth is large. The use of a Y section serves to stabilise the rack bar under the influence of rolling moments caused by the pinion/rack tooth contact forces, in particular the lateral component of these forces caused by the presence of large skew angles. However, in certain circumstances, such as when the skew angles are relatively small, for example during the introductory phase of variable ratio in a particular vehicle model where lesser degrees of ratio change may be employed, it may be desirable to provide the more conventional round cross section at the toothed end of the rack bar so that the rack assumes a section like the letter "D", and the curved back of this section is of a radius substantially concentric with the radius of the shank end of the bar. This arrangement has some manufacturing advantages for power steering gears over racks of Y section in that the toothed end of the rack may be assembled through the inner seal of the power steering cylinder after the piston has been attached to the shank end of the rack bar (a practice well known in the art of manufacture of power steering gears). Also a conventional arcuate shaped rack support pad may be used and the entire rack bar may be finish ground by a through-feed centreless grinding process rather than by plunge grinding only the shank end.

When forging a D section rack, the cross-sectional area of toothed end of the rack bar is less than that of the shank end. It follows that either the rack bar blank must be reduced in diameter over that region later to be forged to form the toothed end or, alternatively, the excess metal must be extruded into side chambers adjoining the main die cavity, forming protrusions which can be removed by subsequent machining. Either approach will enable a power rack bar to pass through the seal and to be processed by through-feed centreless grinding. The present invention addresses the die construction for forging a D section rack employing such chambers. The general configuration of the forging die to be described may remain substantially that of the die described in U.S. Pat. Nos. 4,571,982 or 5,862,701 particularly in regard to the provision to grip the rack bar blank and to provide the necessary end constraints. However, the forming elements disclosed in the prior art are replaced by a pair of opposing die blocks each having a cavity in section corresponding to one or other half of the D section rack but including the above side chambers. The forging die disclosed in U.S. Pat. No. 4,571,982 also provides robust keys that engage as the upper and lower die blocks approach each other so that the die blocks are maintained in precise alignment.

Now, in the manufacture of Y section racks by warm forging, the very high pressures achieved ensure that the tooth cavities of the die are precisely filled over substantially all their length to within a fraction of a millimeter of the tops of the rack teeth. This is particularly important in the on-centre region of variable ratio racks used in power steering gears where the pressure angle is low and tooth contact with the pinion typically occurs only over the top one to two millimeters of the rack teeth. Poor die fill results in a reduction of the total length of the meshing pinion-rack contact lines and hence a corresponding reduction in effective contact ratio. In the case of a D section rack to which the present invention relates, this length of contact is already reduced as compared to that for Y section racks due to the aforementioned narrower rack teeth. The simple two forming element arrangement to be described must be capable of achieving the same very high pressures as the Y forming die.

Satisfactory die fill may be expressed as the meniscus or radius of the formed metal within the cross-section of the toothed cavity where, for example, the flank of the tooth cavity meets the bottom of the cavity. This radius is determined by the hydrostatic pressure of the formed metal within the die cavity. By experience it has been found that this should be of the order of 1100 MPa.

For this reason, the two element die construction illustrated in UK Patent 2088256, with its provision for "flash gutters" each side of the upper die chamber, is impractical in that metal would escape into these gutters before the desired hydrostatic pressure had been reached, particularly at the "hot forging" temperatures specified by the patent. According to this prior art patent specification, the initial hot forging process is followed at a later stage of manufacturing by a cold coining process when the final accuracy of form and tooth fill is achieved. Such a two stage process of forming the fine rack teeth may cause folds or other defects in the material unless precise compensation is made for the variation of temperature between hot forging and cold coining stages.

Likewise, the two die element construction illustrated in UK Patent 2108026, with its provision of a relief cavity whose volume is greater than that which would be filled by excess material displaced into it, would also be impractical in that metal would escape into the relief cavity before the desired hydrostatic pressure is reached to fully form the rack teeth.

Flash gutters are commonly provided in conventional forging dies to allow for the fact that the bar stock material used as blanks in forging operations is subject to a relatively wide variation of diameter, whereas in the processes described in U.S. Pat. No. 4,571,982 and 5,862,701, the blank is precision ground on its diameter to a fine tolerance. The chambers each side of the main die cavity according to the present invention have only a superficial resemblance to conventional flash gutters, and are primarily provided to prevent "pinching" of the metal which inevitably occurs at the joint line between mutually approaching die recesses having substantially semi-circular cross-sections. Other functions of these chambers are referred to later in the specification. Thus these chambers will be present whether or not the diameter of the blank has been reduced in diameter at the (yet to be formed) toothed end or not.

For these chambers to be effective, they must provide positive metal entrapment during the last stages of closing of the die in order to produce the aforementioned high final hydrostatic pressure. In fact, according to the present invention, during the last instant of closing, it is possible for metal from these chambers to re-enter the main die cavity in order to ensure complete die fill.

In one aspect the present invention consists of a die for forming the toothed end of a steering rack bar from a cylindrical blank by forging, the die comprising first and second die blocks relatively moveable to converge on the blank, said die blocks incorporating opposed generally semi circular recesses to accommodate said blank, one recess incorporating the obverse form of the teeth, said recesses defining between them a main cavity as said die blocks converge to their final closed position, subsidiary recesses in one or both die blocks at the joint line there between defining chambers at said final closed position, each side of said main cavity communicating with one of said chambers along all or most of the full longitudinal extent of said main cavity, characterised in that said chambers in cross-section incorporate stop means located laterally remote from said main cavity restricting further flow of blank material away from the main cavity, the volume of the chambers at said final closed position being substantially equal to the difference of volume between the rack bar blank and the steering rack bar as finish forged over the toothed end thereof in the main cavity.

It is preferred that said stop means comprises longitudinally extending abutments on said first die block which overlap respective juxtaposed abutments on said second die block as said final closed position is approached.

Alternatively, or in addition, it is preferred that said chambers are generally tapered in depth in a direction away from said main cavity sufficiently to inhibit further outward flow of blank material as said final closed position is approached.

Preferably, at least a portion of said blank material within said chambers is urged back towards said main cavity as said final closed position is approached.

Preferably each said longitudinal extending abutment on said first die block has a small clearance zone with said respective overlapped juxtaposed abutment on said second die block.

BEST METHOD OF CARRYING OUT THE INVENTION

Figure 1:
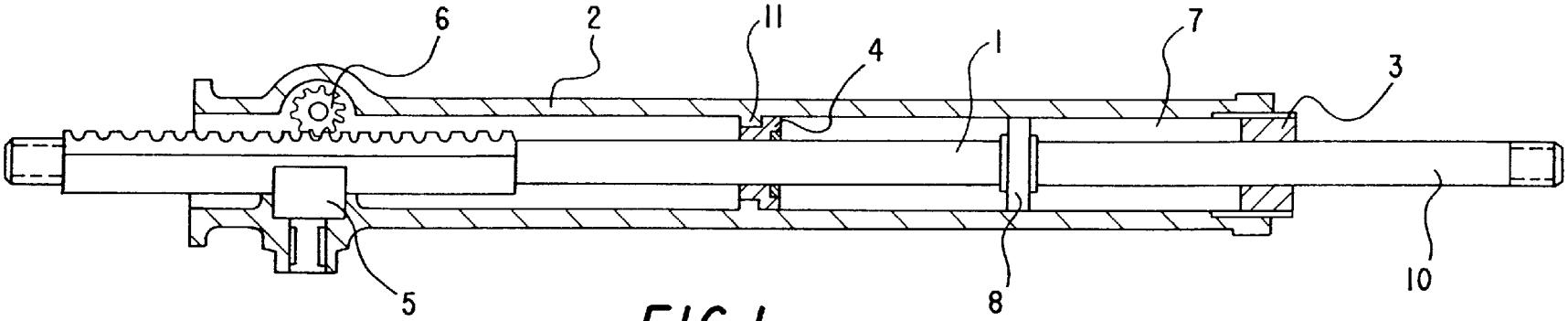
FIG. 1 PRIOR ART
FIG. 1 shows a longitudinal cross-sectional view of a prior art variable ratio rack and pinion steering gear.

FIG. 1 shows one type of variable ratio rack and pinion steering gear which benefits from the manufacturing method and apparatus according to the present invention. Rack bar 1 longitudinally slides in steering gear housing 2 on journals 3 and 4, and on rack support pad 5. Housing 2 is also provided with journals for mounting pinion 6, generally at an angle other than at a right angle to the longitudinal axis of rack bar 1, and pinion 6 is generally of an involute helicoidal form. Housing 2 also incorporates power cylinder 7 in which slides piston 8 securely fixed to rack bar 1. Journals 3 and 4 incorporate seals as does piston 8 so that oil under pressure supplied to one or other end of cylinder 7 provides assist to the driver's effort according to well known power steering art.

Figure 2:
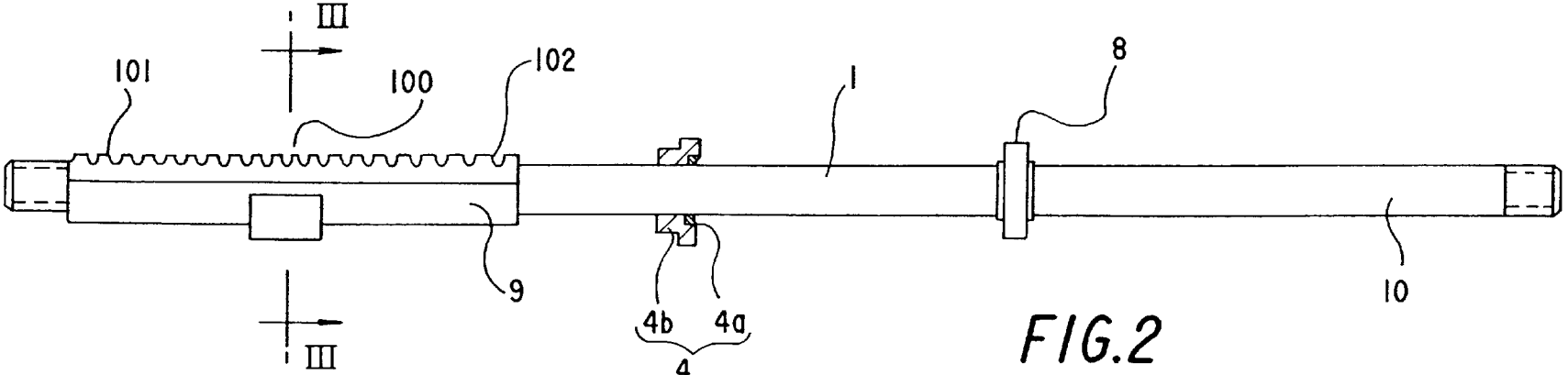
FIG. 2 PRIOR ART
FIG. 2 shows a side elevation of the rack bar and rack support pad installed within the steering gear of FIG. 1.

FIG. 2 shows a typical rack bar as would be installed in the steering gear of FIG. 1, and comprises toothed end 9 and shank end 10 the latter to which is attached piston 8. It will be seen that the teeth are closely spaced in the on-centre region 100 of the rack bar, and smoothly transform to more widely spaces teeth each side thereof towards full-lock regions 101 and 102.

Figure 3:
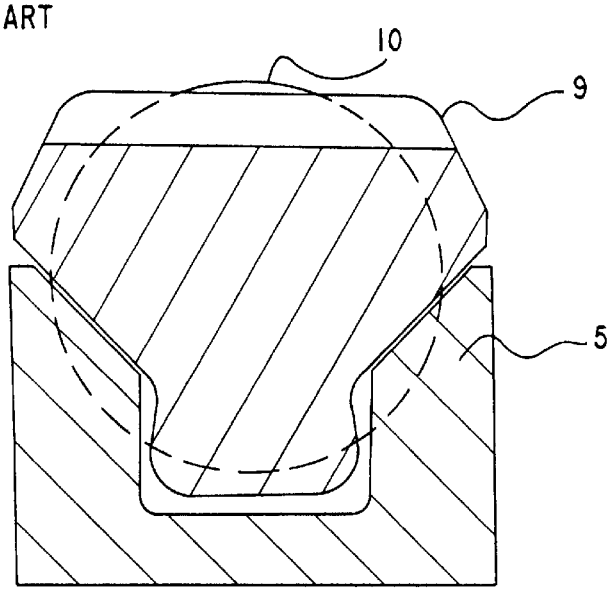
FIG.3 PRIOR ART
FIG. 3 is a cross sectional view of the rack bar and rack support pad of FIG. 2 on Section III—III.

It is preferred that toothed end 9 has a cross-sectional shape illustrated in FIG. 3 (Section III—III of FIG. 2), termed for convenience a Y section in accordance with the teaching of U.S. Pat. No. 4,116,085. Such a rack bar, when journalled in the "V" shaped sliding faces incorporated in rack support pad 5, is substantially free from any rolling tendency about its longitudinal axis caused by meshing contact forces between the teeth of pinion 6 and those of rack 1, for reasons stated in the aforementioned patent.

It is seen from FIG. 3 that toothed end 9 has a larger cross-sectional envelope than shank end 10. Hence journal 4 incorporating seal 4*a* must be assembled on to shank end 10 prior to the attachment and retention (for example by circlips) of piston 8 and prior to assembly in housing 2. Housing 2 is provided with internal abutment 11 into which is pressed the stepped annulus 4*b* of journal 4 during steering assembly.

These techniques have been widely used in power steering gears manufactured for more than a decade and, while well proven, incur some additional cost as compared to a construction normally used in constant ratio power steering gears where the toothed end has substantially the same diameter as the shank end, so that the section of the rack will resemble more the letter D rather than the letter Y.

Figure 4:
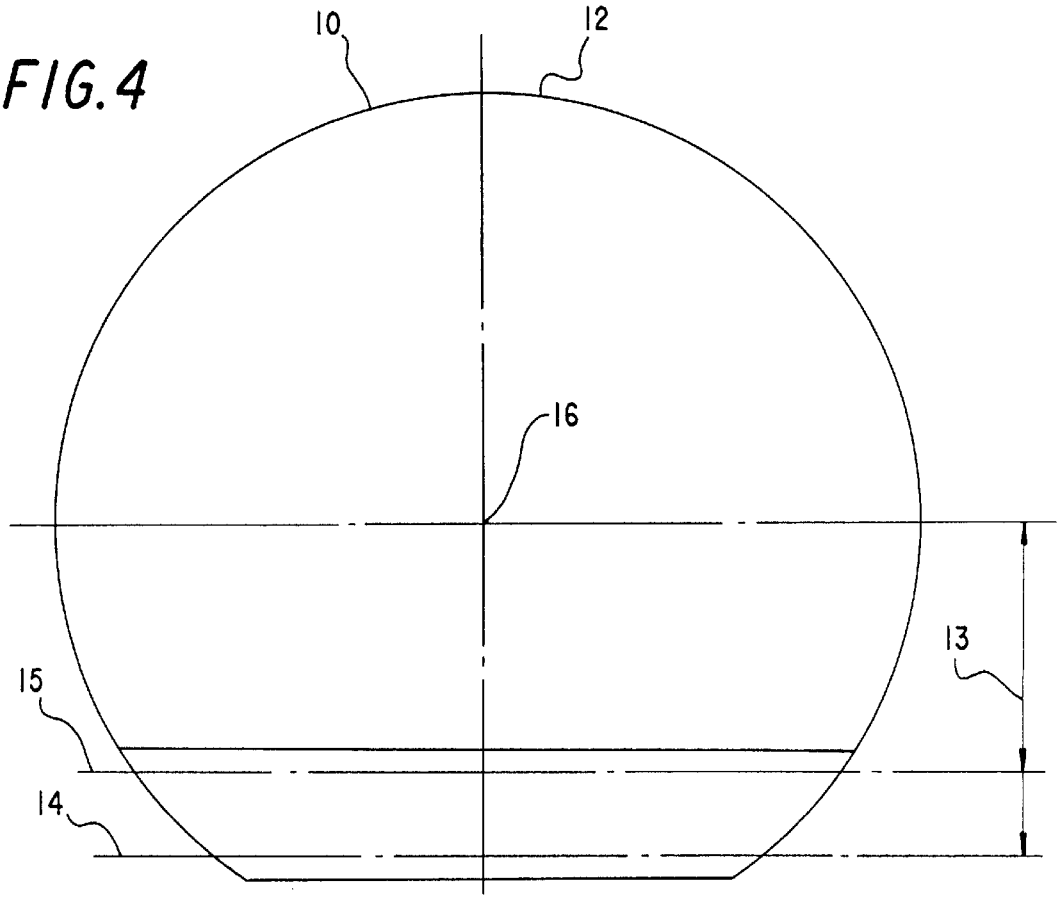
FIG. 4 is a cross sectional view of an embodiment of a D section rack bar which can be made in accordance with the present invention.

Now, as referred to earlier, in certain circumstances a D section rack bar may be preferred over a Y section rack bar for reasons of cost saving. To this end the present invention describes a means whereby the four primary forming elements as described in U.S. Pat. Nos. 4,571,982 and 5,862,701 are replaced by a pair of opposing die blocks, and the rack shape will be a D section as shown in FIG. 4. Side 12 of the toothed end of the rack bar opposing the teeth will now, when finish ground, match that of shank end 10. Note that the rolling moments are largely affected by the distance 13 between the rack bar longitudinal axis 16 and the meshing pitch plane of the rack and pinion teeth, shown as plane 14 for full-lock regions 101 and 102, and plane 15 for on-centre region 100.

Figure 5:
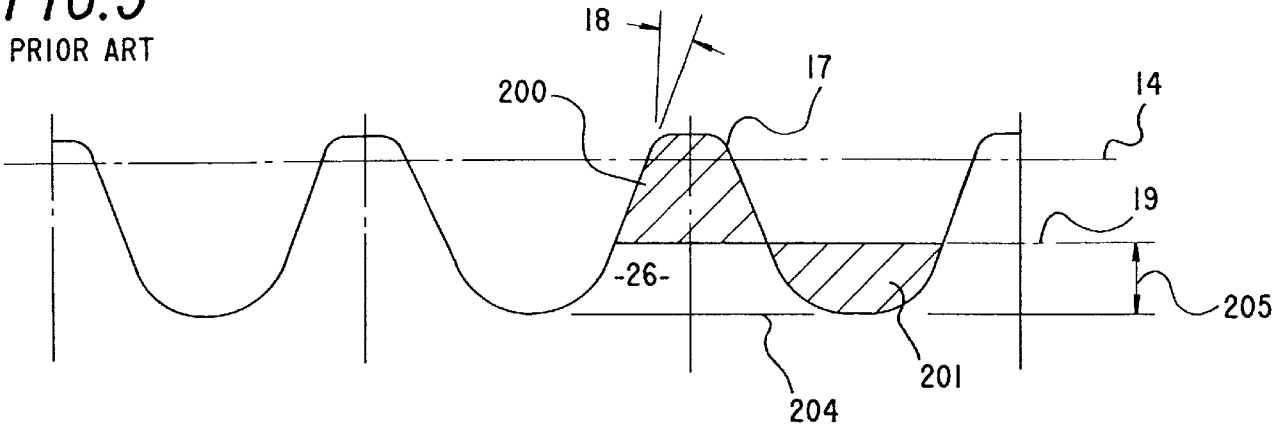
FIG.5 PRIOR ART
FIG. 5 shows a cross sectional view of the teeth through the transverse plane at region 100 of FIG. 2, corresponding to the on-centre region of the rack bar.
Figure 6:
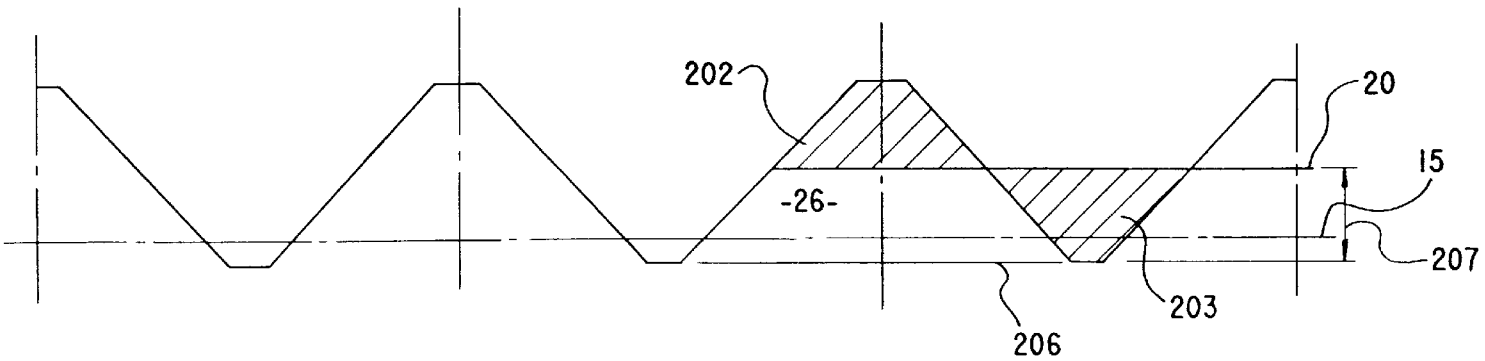
FIG.6 PRIOR ART
FIG. 6 shows a cross sectional view of the teeth through the transverse plane at region 101 of FIG. 2, corresponding to a full-lock region of the rack bar.

FIGS. 5 and 6 show the typical forms of teeth viewed in the transverse planes, that is planes normal to the local skew angle of the teeth, as at regions 100 and 101 respectively of FIG. 2. Teeth of the forms shown may be used where the steering ratio selected for the mid turn or cornering region of the vehicle wheels is selected to be of the order of 60–70% of that of the on-centre or straight ahead position of the wheels.

Now the pressures achieved during forming of the rack bar teeth largely determine the degree of fill of die toothed recess 26 as indicated by the meniscus radii 17, which is generally most difficult to achieve in the on-centre region (FIG. 5) where the transverse pressure angle 18 is small. The teeth shown in FIGS. 5 and 6 have different volumetric mean heights, that is planes 19 and 20 respectively, where the tooth cross-sectional area 200,202 above this mean height equals the tooth gap (ie. the space between the teeth) cross-sectional area 201,203 below this mean height (ie. the cross-hatched areas 200=201 and 202=203). Thus, mean height plane 19 in FIG. 5 is considerably closer to plane 204 of the bottom of the teeth (indicated as height 205) than in the case of the corresponding planes of the high pressure angle teeth as shown in FIG. 6 (distance between planes 20 and 206 indicated as height 207). The total die cavity volume per unit length must take into account these varying tooth volumes if the degree of fill achieved on the rack bar is to be maintained constant along its length. Considerations must also be given to the inevitable variations of stiffness of the die blocks along their length.

The remaining description of the forging die which, according to the invention, is suited to the warm forming of D section rack bars relates to the pair of opposing die blocks. As mentioned earlier, the remainder of the die can be considered to be substantially as described in U.S. Pat. No. 5,862,701. Thus appropriate cavities are provided within the upper and lower bolsters (or die members), numbered 18 and 19 in FIGS. 3 and 4 of that prior art specification, to accommodate rectangular die blocks 21 and 22 in FIG. 7 of the present specification. When bottom stroke position of the forging operation is reached (ie. final die closure), the die blocks jointly define a main cavity 23 and chambers 24 located on each side thereof which, in most cases, will extend substantially over the entire length of the die blocks. Further details of main cavity 23 and chambers 24 are shown in FIG. 8.

The precisely ground rack blank 25 here shown at position 25*a* directly above toothed recess 26 of lower die block 22 at the instant of contact of blank 25 with semi circular recess 27 of upper die block 21 in position 27*a*. Successive positions of semi circular recess 27 and blank 25 are indicated by suffixes b, c and d.

On each side of main cavity 23 there are abutments 28 and 29 of lower die block 22 and upper die block 21, respectively. Each abutment 29 overlaps corresponding juxtaposed abutment 28 thereby jointly defining a "stop means" at the laterally remote end of each chamber 24, which restricts flow of material away from main cavity 23 as the final closed position of die blocks 21 and 22 is approached.

The exact proportions of chambers 24 will be influenced by many factors. For example they must be of sufficient width 50 so that raised abutment 28 can resist the lateral shear stress imposed during the final closing of the die.

The optimum sectional shape of chambers 24 for a particular design of D section rack bar may be arrived at by trial and error or by the use of computer modelling programs. Such programs may typically have as inputs some or all of the following information.

- The velocity/time relationship of the platens of the press during closing.
- The properties of the materials to be used, in this case one of a wide range of steels.
- The temperature at which the steels selected flows most readily but less than that at which a metallurgical phase change occurs during cooling, such as the Austenitic transformation temperature.
- The viscous properties of the steel at various shear velocities.
- The coefficient of friction during the flow of steel within the die having regard to the die finish, lubrication used etc.

The variables used in proportioning the chambers include:

- width 50 influenced by the shear strength of raised abutment 28. Furthermore the height 59 of abutment 28 should be minimized to limit the combined bending and shear stresses imposed on abutment 28 during the final closure of the die. Preferably width 50 is larger than height 59;

mean depth 51 of chamber 24;

taper angles at 52 and 55, which are incorporated so that the dies may most readily be electro discharge machined after wear occurs. A small clearance zone 54 will exist at the interface of abutments 28 and 29 of die blocks 22 and 21 respectively, to allow for slight mismatch of main die blocks due to possible slight alignment of the keying elements between the upper and lower bolsters;

radii 53 at the entry to the main cavity 23 to assist flow in and out of chambers 24;

total volume of chambers 24, (shown hatched in left hand side of FIG. 8) should equate to the volume 120 (shown hatched in the left hand side of FIG. 8) bounded by the mean height of the teeth as defined earlier as shown in FIGS. 5 and 6, and the hypothetical arcuate periphery of die block 22 (if the teeth were not present) at final die closure.

In the embodiment shown in FIG. 8 the chambers 24 and raised abutments 28 of die block 22 are tapered in depth in a direction away from main die cavity 23 such that, immediately before final closure, a portion of blank material within chambers 24 is urged back towards main cavity 23 and away from potential entrapment in clearance zone 54. This urging of blank material back towards main cavity 23 ensures that effective tooth fill is achieved.

Mean depth 51 of chambers 24 may be varied along the length of one or both chambers in order to compensate for the varying volume mean height of the teeth as discussed previously and other factors such as bulk deformation of the die blocks and bolsters. FIG. 9 is a cross sectional view through IX—IX of FIG. 8 showing this variation in depth.

Alternatively the die may be further simplified by inverting the die elements so that the toothed die block is located in the moving bolster. The prior art gripper and lower bolster of U.S. Pat. No. 5,862,701 may now be fixed and comprises a block having a semi-circular cavity which is precisely an extension of the partly semi-circular recess 27 of die block 21 as shown in FIG. 8 of the present specification, but without chambers 24. By this means exact co-axiality of the toothed end and shank end of the rack is assured.

Figure 7:
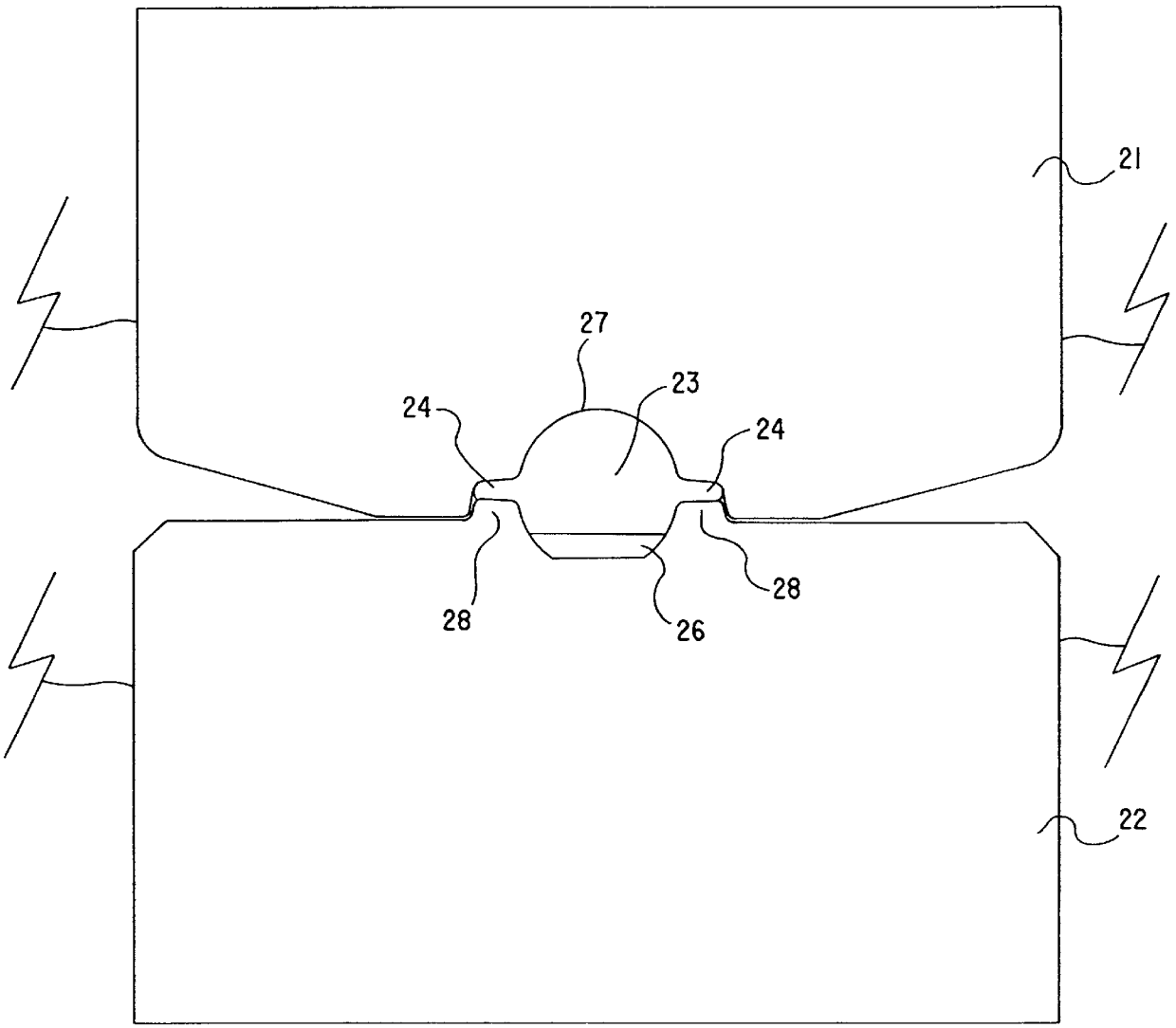
FIG. 7 is a cross sectional view of one embodiment of the die blocks of the die according to the present invention.
Figure 8:
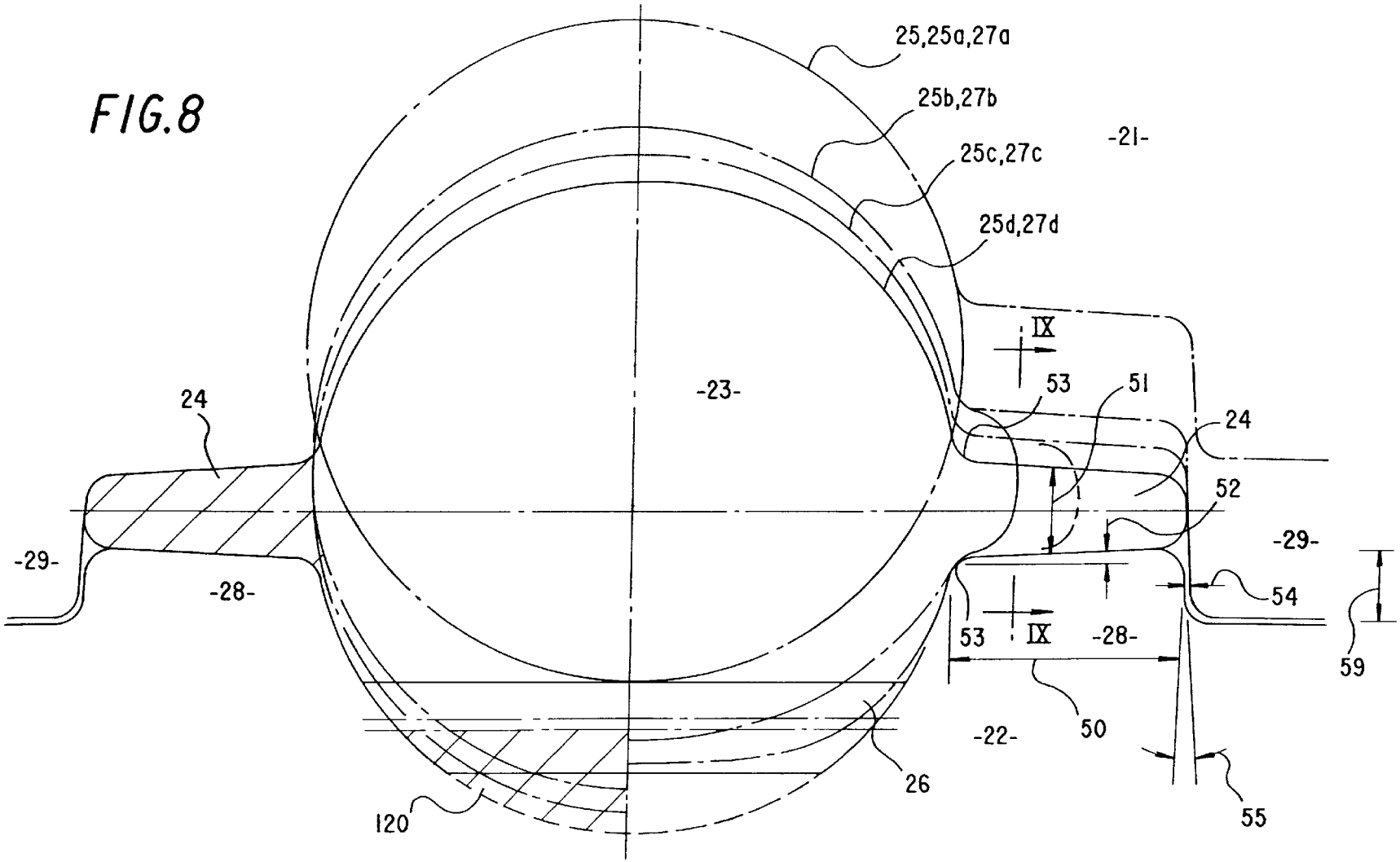
FIG. 8 is an enlarged schematic of the die blocks at four successive positions from when the blank first contacts the upper die block to full closure of the die.
Figure 9:
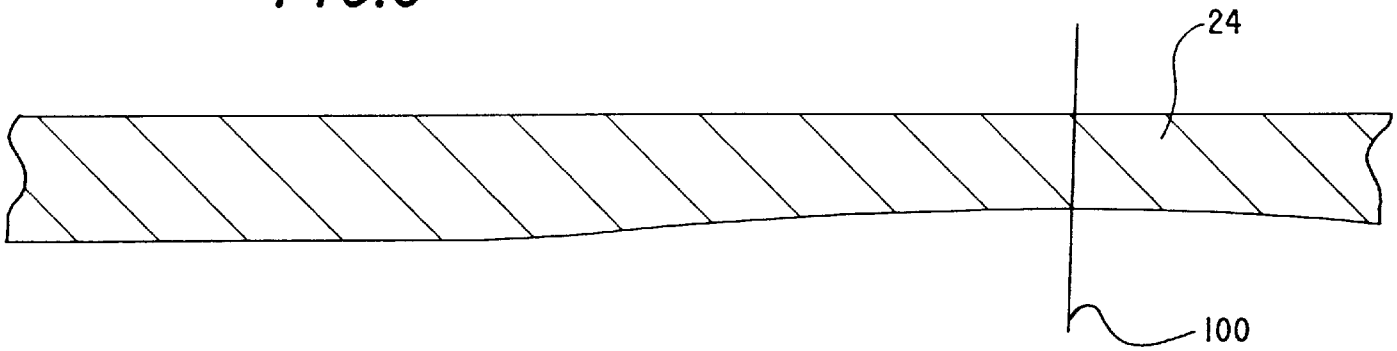
FIG. 9 is a cross sectional view on Section IX—IX of FIG. 8.
Figure 10:
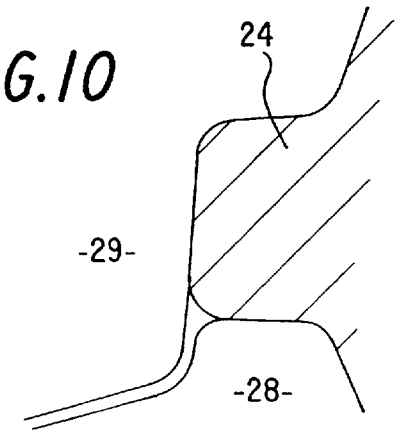
FIG. 10 is a cross sectional view of an alternative embodiment of the die block abutments and chamber which jointly define the stop means.

FIG. 10 depicts an alternative embodiment, in which chamber 24 and abutments 28 and 29 of die blocks 22 and 21, differ in width to depth ratio to that shown in the earlier embodiment of FIGS. 7 and 8. The shape and size of chamber 24 and abutments 28 and 29 may differ depending on the size and shape of the rack to be forged, the important requirement being that each chamber 24 is fully filled with blank material at final die closure.

It will be recognised by persons skilled in the art that numerous variations and modifications may be made to the invention without departing from the spirit and scope of the invention.

I claim:

1. A die for forming a toothed end of a steering rack bar from a cylindrical blank by forging, the die comprising first and second die blocks relatively moveable to converge on the blank, said die blocks incorporating opposed generally semi circular recesses to accommodate said blank, one recess incorporating an obverse form of the teeth, said recesses defining between them a main cavity as said die blocks converge to their final closed position, subsidiary recesses in one or both die blocks at a joint line there between defining chambers at said final closed position, each side of said main cavity communicating with one of said chambers along all or most of a full longitudinal extent of said main cavity, wherein said chambers in cross-section incorporate stop means located laterally remote from said main cavity, said stop means comprising longitudinally extending abutments on said first die block overlapping respective juxtaposed abutments on said second die block as the final closed position is approached, said stop means restricting further flow of blank material away from the main cavity while preventing blank material from flowing between the overlapped juxtaposed abutments, a volume of the chambers at the final closed position being substantially equal to a difference of volume between the rack bar blank and the steering rack bar as finish forged over the toothed end thereof in the main cavity.

2. A die as claimed in claim 1 wherein said chambers are generally tapered in depth in a direction away from said main cavity sufficiently to inhibit further outward flow of blank material as said final closed position is approached.

3. A die as claimed in claim 2, wherein at least a portion of blank material within said chambers is urged back towards said main cavity as said final closed position is approached.

4. A die as claimed in claim 1, wherein each said longitudinal extending abutment on said first die block has a small clearance zone with said respective overlapped juxtaposed abutment on said second die block.

* * * * *